US006257873B1

(12) United States Patent
Song

(10) Patent No.: US 6,257,873 B1
(45) Date of Patent: Jul. 10, 2001

(54) COMBINATION LIGHTER AND CIGAR CUTTER

(76) Inventor: Ho Nam Song, Duksan Vila 102, 227-16 Gueuidong, Kwanghinku, Seoul (KR)

( * ) Notice: Subject to any disclaimer, the term of this patent is extended or adjusted under 35 U.S.C. 154(b) by 0 days.

(21) Appl. No.: 09/457,982

(22) Filed: Dec. 9, 1999

Related U.S. Application Data

(63) Continuation-in-part of application No. 29/111,683, filed on Oct. 1, 1999.

(51) Int. Cl.[7] ..... F23Q 2/34; A24F 13/24
(52) U.S. Cl. ..... 431/253; 131/249
(58) Field of Search ..... 131/185, 249, 131/248, 250, 234, 243, 178, 253, 254, 255, 250.1, 251; 431/253, 129, 144; 30/109, 113.3, 111; 7/158; D27/143, 142

(56) References Cited

U.S. PATENT DOCUMENTS

| | | | | |
|---|---|---|---|---|
| 306,672 | | 10/1884 | Brown | 131/249 |
| D. 377,845 | | 2/1997 | Maruyama . | |
| D. 387,474 | | 12/1997 | Fontaine, Jr. . | |
| D. 404,520 | | 1/1999 | Kim . | |
| D. 410,563 | * | 6/1999 | Reynolds | D27/143 |
| 661,667 | | 11/1900 | McIntyre | 131/249 |
| 815,219 | | 3/1906 | Rooll | 131/249 |
| 1,068,300 | | 7/1913 | Baumbach | 131/249 |
| 1,502,974 | | 7/1924 | Aronson | 131/249 |
| 2,499,752 | | 3/1950 | Hrabal | 431/253 |
| 4,600,022 | * | 7/1986 | Pierce, Jr. | 131/249 |
| 4,897,033 | | 1/1990 | Yang | 431/253 |
| 5,738,117 | | 4/1998 | Fontaine, Jr. | 431/253 |
| 5,740,816 | * | 4/1998 | Ghazarian et al. | 131/248 |
| 5,911,573 | * | 6/1999 | Tsai | 131/249 |
| 5,913,676 | * | 6/1999 | Kim | 131/249 |
| 5,934,894 | * | 8/1999 | Cigler | 131/249 |
| 6,151,781 | * | 11/2000 | Dehler | 431/253 |

FOREIGN PATENT DOCUMENTS

| | | | | |
|---|---|---|---|---|
| 1126357 | * | 11/1956 | (FR) | 431/253 |
| 319054 | * | 9/1929 | (GB) | 431/253 |

OTHER PUBLICATIONS

Product Catalog of East–West Trading Corporation.

* cited by examiner

*Primary Examiner*—Ira S. Lazarus
*Assistant Examiner*—Josiah C. Cocks
(74) *Attorney, Agent, or Firm*—Barnes & Thornburg

(57) ABSTRACT

A combination lighter and cigar cutter comprising a lighter body adapted to create a flame, and a cigar cutter removably engaged with the lighter body. The cigar cutter is adapted to be disengaged from the lighter body for cutting a cigar. Desirably, the lighter body defines an opening receiving the cigar cutter, and the cigar cutter is threadably engaged with the lighter body. The lighter body may comprise a lighter casing and an engaging member for engaging the cigar cutter and the lighter casing. Desirably, the engaging member is generally hollow and cylindrical and includes a threaded inner wall that defines a through passage and openings on each end, one for receiving the cigar cutter and one for receiving the lighter casing. The threaded inner wall engages complementary threads on the cigar cutter and complementary threads on the lighter casing. The cigar cutter can be disengaged from the lighter body for cutting a cigar and then re-engaged with the lighter body. The combination lighter and cigar cutter is neat and compact and can be used to cut and light cigars in an effective manner.

19 Claims, 2 Drawing Sheets

COMBINATION LIGHTER AND CIGAR CUTTER

This is a continuation-in-part of U.S. Design patent application, Ser. No. 29/111,683, filed Oct. 1, 1999, entitled "Combination Lighter and Cigar Cutter".

FIELD OF THE INVENTION

The present invention relates to a combination lighter and cigar cutter.

BACKGROUND

Combining cigar cutters with lighters is known in the art. Such devices often have awkward configurations, however, because cigar cutters often do not complement the shape of lighters. As a result, such devices may be awkward to handle and use. Additionally, the cigar cutters are typically exposed even when they are not being used, which may present many problems. For example, because it is exposed, a cigar cutter encounters moisture, dirt, dust or other undesirable matter which will affect the effectiveness as well as the lifespan of the cigar cutter. An exposed cigar cutter also may present safety concerns.

Therefore, it is an object of the present invention to provide a combination lighter and cigar cutter having a neat and compact appearance.

It is a further object of the present invention to provide a combination lighter and cigar cutter wherein the cigar cutter can be readily disengaged from the lighter body for cutting a cigar and then readily reengaged with the lighter body.

It is a still further object of the present invention to provide such a device wherein the cutting edge of the cigar cutter is not exposed when the cigar cutter is engaged with the lighter body.

SUMMARY

In accordance with these and other objects, the present invention provides a lighter device comprising a lighter body adapted to create a flame, and a cigar cutter removably engaged with the lighter body. The cigar cutter is adapted to be disengaged from the lighter body for cutting a cigar. Desirably, the lighter body defines an opening receiving the cigar cutter, and the cigar cutter is received within the opening and is threadably engaged with the lighter body. The cigar cutter may define a hole for receiving the cigar for cutting.

The lighter body is threadably or otherwise engaged with the cigar cutter in any suitable manner. In a preferred embodiment, for example, the lighter body comprises an engaging member for engaging the cigar cutter, and a lighter casing. Desirably, the engaging member is generally hollow and cylindrical and includes an inner wall that defines a through passage and openings on each end, one for receiving the cigar cutter and one for receiving the lighter casing. The inner wall may be threaded for engaging complementary threads on the cigar cutter and for engaging complementary threads on the lighter casing. The lighter body may have any suitable construction and the lighter device may include any suitable lighter mechanism constructed in any suitable manner and associated with the lighter body in any suitable manner.

Accordingly, the present invention provides a combination lighter and cigar cutter that is neat and compact and that can be used to cut and light cigars in an effective manner. With the lighter device in accordance with a preferred embodiment, the cigar cutter can be readily disengaged from the lighter body for cutting a cigar and then readily re-engaged with the lighter body. Desirably, the cigar cutter includes a cutting edge that is substantially concealed when the cigar cutter is in the engaged position. Thus, the cutting edge of the cigar cutter is not always exposed to moisture, dirt, dust or other undesirable matter and, as a result, tends to have a longer life than the cigar cutters of prior art devices. Additionally, when the cigar cutter is engaged with the lighter body, it may be less likely to cause injury than the cigar cutters of prior art devices.

BRIEF DESCRIPTION OF THE DRAWINGS

The present invention and the advantages thereof will become more apparent upon consideration of the following detailed description when taken in conjunction with the accompanying drawings.

DETAILED DESCRIPTION OF PREFERRED EMBODIMENTS

Figure 1:
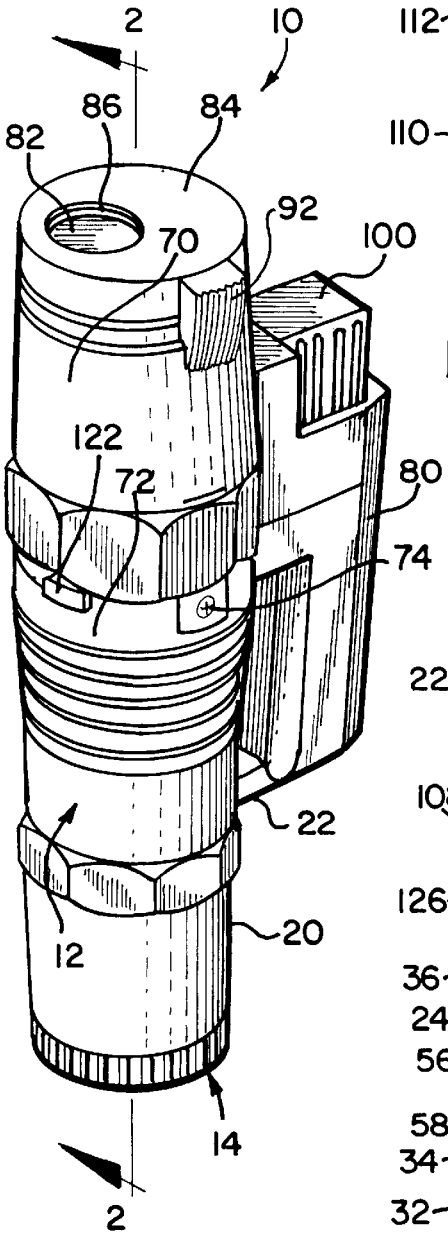
FIG. 1 is a perspective view of a lighter device having a cigar cutter in accordance with a preferred embodiment of the invention, with the cigar cutter engaged with the lighter body.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

Figure 2:
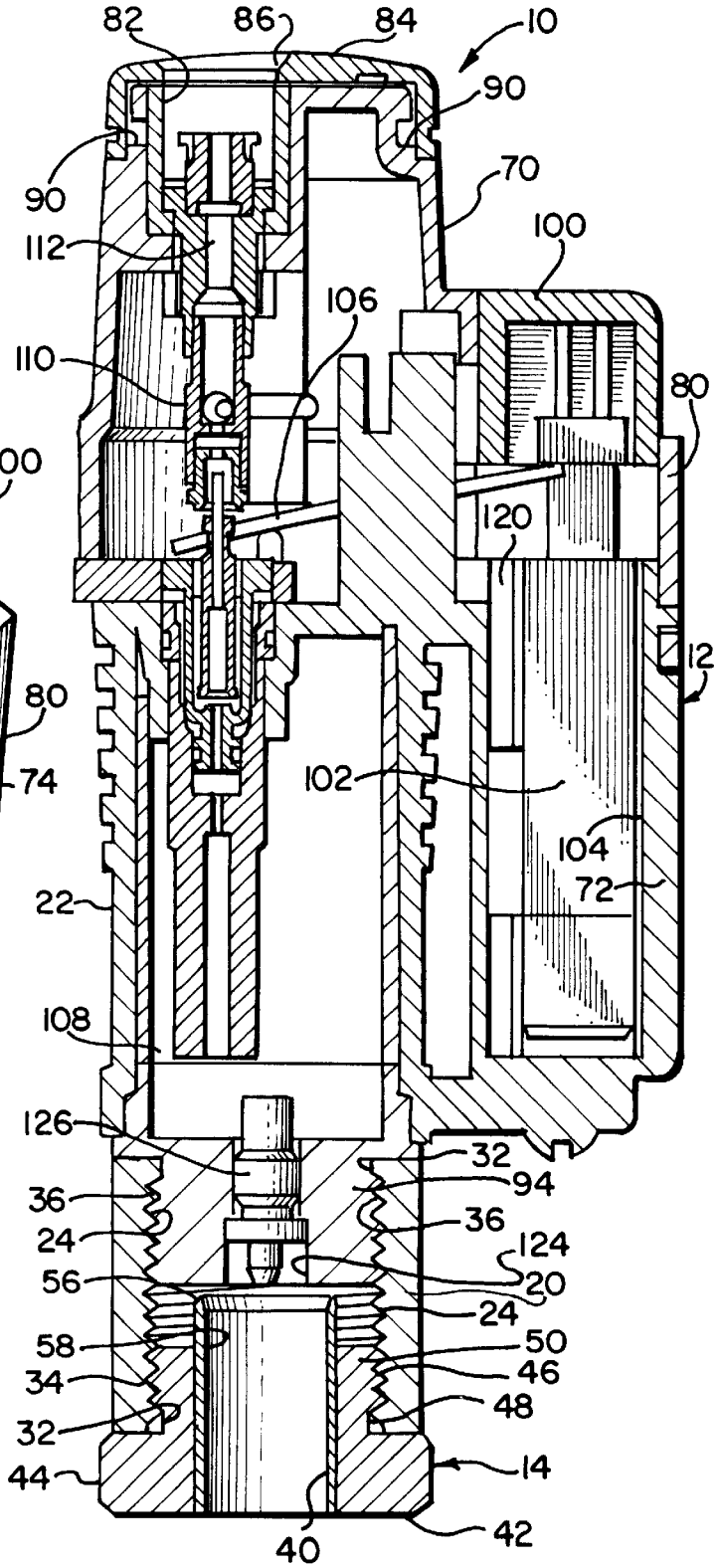
FIG. 2 is a cross section view taken along the lines 2—2 of FIG. 1.
Figure 3:
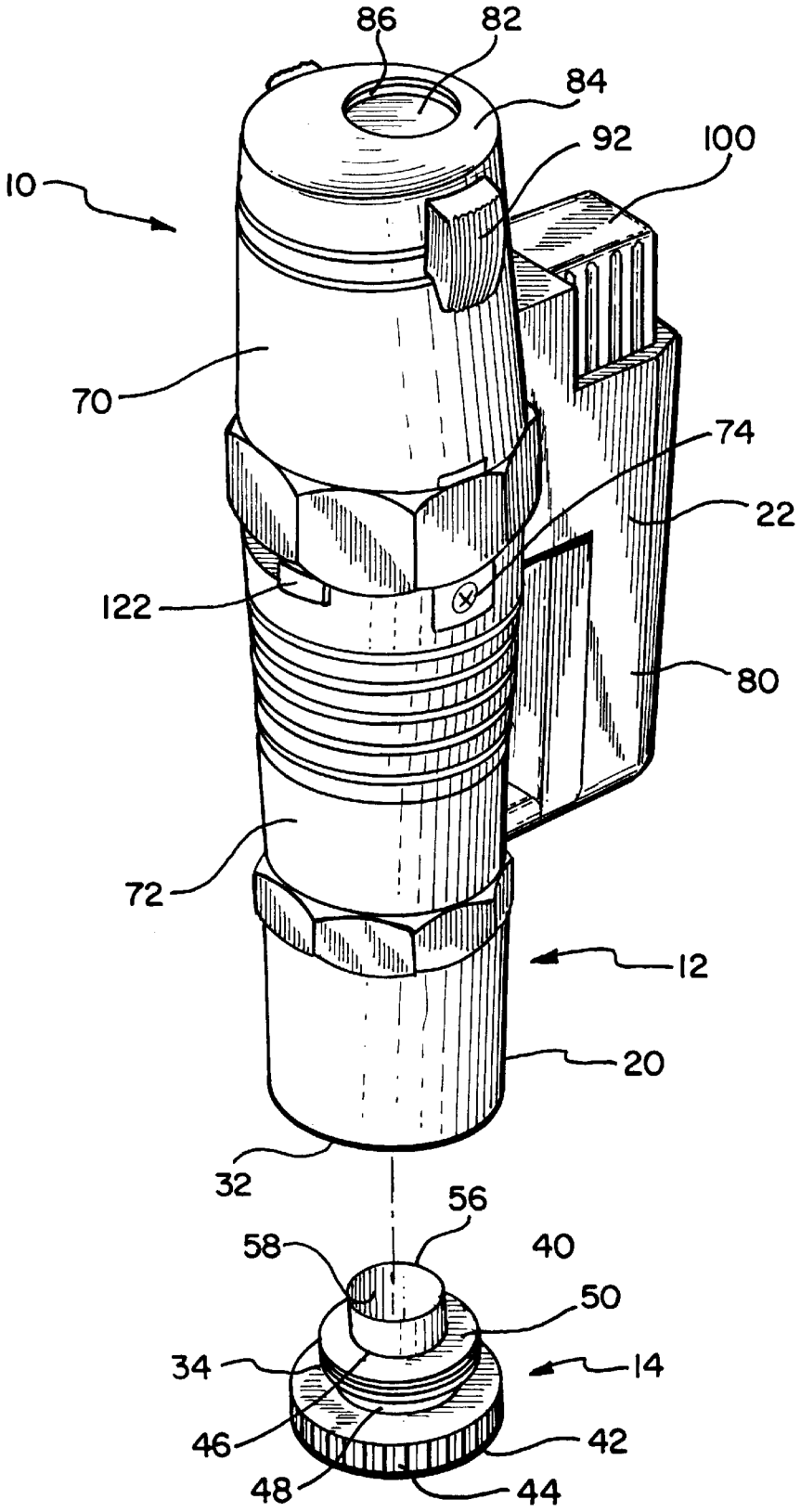
FIG. 3 is a perspective view of the lighter of FIG. 1, with the cigar cutter disengaged from the lighter body.

FIGS. 1–3 illustrate a lighter device 10 in accordance with a preferred embodiment of the invention comprising generally a lighter body 12 and a cigar cutter 14 removably engageable with the lighter body. FIGS. 1 and 2 illustrate the cigar cutter 14 engaged with the lighter body 12. FIG. 3 illustrates the cigar cutter 14 disengaged from the lighter body 12 for cutting a cigar.

The lighter body 12 may have any suitable configuration and may be threadably or otherwise engaged with the cigar cutter 14 in any suitable manner. In the illustrated embodiment, for example, the lighter body 12 includes a generally hollow and cylindrical engaging member 20 and a lighter casing 22. The engaging member 20 desirably includes a threaded inner wall 24 that defines a through passage 30 and openings 32 on each end of the engaging member contiguous with the passage 30. The threaded inner wall 24 may be threaded along all, along some, or along one or more portions of the length of the engaging member 20. The illustrated cigar cutter 12 is received within one opening 32 and includes threads 34 that engage the threaded inner wall 24 of the engaging member 20, and the illustrated lighter casing 22 is received within the other opening 32 and includes threads 36 that engage the threaded inner wall 24 of the engaging member 20.

The cigar cutter 12 may have any suitable construction. In the illustrated embodiment, the cigar cutter 14 comprises a cutting member 40 and a base member 42 disposed about the cutting member. The base member 42 includes a disk-shaped member 44 and a stem 46 extending therefrom comprising an unthreaded portion 48 and a threaded portion 50 which includes the threads 34 which engage the engaging member 20. The disk-shaped member 44 may be ribbed to facilitate gripping. The cutting member 40 desirably is cylindrical and terminates in a cutting edge 56. The cigar cutter 14 defines a hole 58 for cutting the cigar. In the illustrated embodiment, the hole 58 is a through hole defined by the cylindrical cutting member 40. Desirably, the outer diameter of the disk shaped member 44 and the engaging member 20 are substantially the same, and substantially all of the stem 46 is received by the engaging member.

The cutting member 40 may be constructed of any suitable material such as, for example, metal or the like, and the cigar cutter 14 may be constructed of steel or any other suitable material. The cutting member 40 and base member 42 may be secured together in any suitable manner, such as, for example, by an adhesive or the like.

The illustrated cigar cutter 14 may be disengaged from the lighter body 12 by manually unscrewing it from the lighter body 12. Once the cigar cutter 14 is disengaged from the lighter body 12 it can be used for cutting cigars. Thereafter, the cigar cutter 14 may be re-engaged to the lighter body 12 by manually screwing it back on in the reverse direction. When the cigar cutter 14 is in the engaged position, the cutting edge 56 desirably is concealed within the engaging member 20. If desired, the lighter device 10 may also include a strap, chain or other suitable structure (not shown) connecting the lighter body 12 and cigar cutter 14 together so that the cigar cutter 14 will not be lost when the cigar cutter 14 is disengaged from the lighter body 12.

The illustrated lighter casing 22 includes a top portion 70 and a bottom portion 72 which are secured together by a plurality of screws 74 and which together form a switch handle 80. The top portion 70 defines a bore 82 for emitting a flame. The top portion 70 may include a swivel lid 84 for opening and closing the bore 82. The illustrated swivel lid 84 defines an aperture 86 for opening the bore 82 by aligning therewith. The swivel lid 84 is secured to the body of the lighter casing 22 in any suitable manner and may, for example, include a pair of stems or screws (not shown) rigidly engaged or integral with the swivel lid 84 that are received within a slot 90 formed near the top of the lighter casing 22 for receiving the stems or screws to permit manual swiveling or rotation. In a preferred embodiment, the swivel lid 84 is adapted to rotate back and forth about 180° to open and close the bore 82. The illustrated embodiment also includes reinforcements 92 for the stems or screws.

The top portion 70 may be made of any suitable material such as any suitable metal or the like. The top and bottom portions 70 and 72 may have any suitable construction. In the illustrated embodiment, the bottom portion 72 includes a stem 94 having the threads 36 for threadably engaging member 20. The bottom portion 72 may be constructed of any suitable material. For example, the bottom portion 72 may be constructed of any suitable metal or of any suitable polyethylene material.

The lighter body 12 may include any suitable lighter mechanism. In the illustrated embodiment, for example, the lighter mechanism is associated with the lighter casing 22 and includes a lighter switch 100 associated with the switch handle 80, an igniter 102 received in a bore 104 defined by the switch handle 80, a lever arm 106, a fuel container 108 housed in the bottom portion 72 having a fuel valve 110, and a lighter valve 112 housed within the top portion 70 in flow communication with the fuel valve. The igniter 102 includes a conduit 120 that extends to the bore 82 of the top portion 70. The illustrated embodiment also includes a fuel switch 122 for increasing the fuel flow and, thus, the size of the flame. The bottom portion 72 of the lighter casing 22 may also define one or more apertures 124 for receiving a refill valve 126 or the like for use in connection with the fueling of the fuel container 108.

The illustrated lighter mechanism operates as follows. The lighter switch 100 is manually depressed, causing the lever arm 106 to open the fuel valve 110 of the fuel container 108 and causing fuel to be passed from the fuel container through the fuel valve 110 and the lighter valve 112 and into the bore 82, and also causing the igniter 102 to create a spark within the bore 82 of the lighter casing 22. The fuel emitted by the lighter valve 112 is ignited by the spark causing the flame to be emitted out of the bore 82. The flame will stay lit for as long as the lighter switch 100 remains depressed or until the swivel lid 84 is rotated to the closed position.

The present invention provides a combination lighter and cigar cutter that is neat and compact and that can be used to cut and light cigars in an effective manner. With the lighter device 10 in accordance with a preferred embodiment, the cigar cutter 14 can be disengaged from the lighter body 12 for cutting a cigar and then re-engaged with the lighter body 12. Desirably, the cutting edge 56 of the cigar cutter 14 is substantially concealed when the cigar cutter 14 is in its engaged position, and, thus, is not always exposed to moisture, dirt, dust or other undesirable matter and tends to have a longer life than the cigar cutter of the prior art devices.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A lighter device comprising (a) a lighter body adapted to create a flame;

(b) a cigar cutter including a generally cylindrical cutting member the cigar cutter removably engaged with the lighter body, the cigar cutter adapted to be disengaged from the lighter bode for cutting a cigar;

wherein the lighter body comprises an engaging member engaging the cigar cutter, and wherein the engaging member is hollow and generally cylindrical and each end of the engaging member defines an opening.

2. The lighter device of claim 1 wherein the engaging member defines an opening receiving the cigar cutter.

3. The lighter device of claim 2 wherein the engaging member includes a threaded inner wall defining the opening, the cigar cutter being threadingly engaged with the threaded inner wall.

4. The lighter device of claim 3 wherein the lighter body comprises a lighter casing threadingly engaged with the threaded inner wall.

5. The lighter device of claim 1 wherein the lighter body comprises a lighter casing received within one opening, the cigar cutter received within the other opening, the engaging member includes an inner threaded wall defining the openings and threadingly engaging the lighter casing and threadingly engaging the cigar cutter.

6. The lighter device of claim 1 wherein the cigar cutter defines a hole for cutting the cigar.

7. The lighter device of claim 1 wherein the cutting member terminates in a cutting edge.

8. The lighter device of claim 7 wherein the cutting edge is concealed by the lighter body.

9. A lighter device comprising (a) a lighter body adapted to create a flame;

(b) a cigar cutter including a generally cylindrical cutting member, the cigar cutter removably engaged with the lighter body, the cigar cutter adapted to be disengaged from the lighter body for cutting a cigar;

wherein the lighter body comprises a lighter casing and an engaging member including a threaded inner wall defining a passage, the threaded inner wall threadingly engaging the cigar cutter and the lighter casing.

10. The lighter device of claim 9 wherein the engaging member is generally hollow and cylindrical.

11. The lighter device of claim 9 wherein the cigar cutter defines a hole for cutting the cigar.

12. The lighter device of claim 9 wherein the cutting member terminates in a cutting edge.

13. The lighter device of claim 12 wherein the cutting edge is concealed by the cutting body.

14. A lighter comprising (a) a lighter body adapted to create a flame, the lighter body including a lighter casing, and an engaging member having two ends and defining an opening at each end, the lighter casing received within one opening of the engaging member and being threadingly engaged with the engaging member;

(b) a cigar cutter received within the other opening of the engaging member and being threadingly engaged with the engaging member, the cigar cutter adapted to be threadingly disengaged from the engaging member for cutting a cigar, the cigar cutter including a generally cylindrical cutting member defining a hole for receiving the cigar.

15. The lighter device of claim 14 wherein the engaging member is generally hollow and cylindrical.

16. The lighter device of claim 14, wherein the engaging member defines a through passage contiguous with the openings.

17. The lighter device of claim 14 wherein the engaging member is internally threaded.

18. The lighter device of claim 14 wherein the cutting member terminates in a cutting edge.

19. The lighter device of claim 18 wherein the cutting edge is concealed by the lighter body.

* * * * *